US005524101A

United States Patent [19]

Thorgersen et al.

[11] Patent Number: 5,524,101

[45] Date of Patent: Jun. 4, 1996

[54] MOTION CONTROLLED CLOCK WITH ALARM AND FLASHLIGHT FEATURES

[75] Inventors: Harold Thorgersen, Woodbury; Bruce H. Kamens, Thomaston; Jose Santana, Woodbury; John T. Houlihan, Southbury, all of Conn.

[73] Assignee: Timex Corporation, Middlebury, Conn.

[21] Appl. No.: 494,984

[22] Filed: Jun. 26, 1995

[51] Int. Cl.[6] ..... G04B 47/00; G04B 19/22; G04B 23/00

[52] U.S. Cl. ..... 368/10; 368/67; 368/227; 368/263

[58] Field of Search ..... 368/10, 67, 72–74, 368/226, 227, 250, 262–263

[56] References Cited

U.S. PATENT DOCUMENTS

| | | | |
|---|---|---|---|
| 4,527,096 | 7/1985 | Kindlmann | 368/67 |
| 4,910,652 | 3/1990 | Rhine | 368/227 |
| 4,995,016 | 2/1991 | Watanabe | 368/67 |
| 5,265,071 | 11/1993 | Thorgersen | 368/67 |
| 5,339,294 | 2/1994 | Rodgers | 368/67 |

OTHER PUBLICATIONS

Magazine advertisement for #PRM493—Remington Motion Control Projection Clock, Lifestyle Function. p. 24.

*Primary Examiner*—Vit W. Miska

*Attorney, Agent, or Firm*—William C. Crutcher; David H. Hwang

[57] ABSTRACT

An alarm clock has a motion sensor, a time display comprising an electroluminescent dial, a manual alarm actuator with a lip cover and a flashlight actuator. When the manual alarm actuator is set in the ON position, any movement (e.g., waving a hand) in the field of view of the motion sensor causes the electroluminescent dial to become activated to a first brightness level. Furthermore, when the alarm is sounding, any movement in the field of view of the motion sensor silences the alarm for a preselected time interval, before the sounding of the alarm is resumed ("snooze" function). In the OFF position for the manual alarm actuator, the lip cover covers the motion sensor so that motion detection is prevented. When the flashlight actuator is actuated, the electroluminescent dial becomes activated to a second brightness level. The second brightness level is noticeably brighter than the first brightness level. The alarm clock has circuit means coupled to a driving circuit for the electroluminescent dial for selecting either the first or the second brightness level.

21 Claims, 4 Drawing Sheets

MOTION CONTROLLED CLOCK WITH ALARM AND FLASHLIGHT FEATURES

This invention relates to an improved alarm clock having an electroluminescent dial and a motion sensor which controls the "snooze" and light functions. Furthermore, the alarm clock has a flashlight feature which may be activated by a manual switching means.

BACKGROUND OF THE INVENTION

Motion sensors, such as pyroelectric infrared detectors, have been adapted for use in many applications. One application involves incorporating a motion sensor into a lighting system so that when someone enters the "field of view" of the motion sensor, a light is turned on. Another application, which has gained popularity recently, is the incorporation of a motion sensor in an alarm clock to control the "snooze" and light functions. For example, the "Wave Logic Travel Clock" manufactured by Saitek Ltd. has an infrared sensor which silences the alarm for approximately four minutes when a hand is waved in the field of view of the sensor. In addition, detection of motion by the sensor causes the incandescent dial light of the Clock to turn on for approximately three seconds.

A variation of such an alarm clock is an alarm clock manufactured by Braun. The Braun alarm clock has a motion sensor which silences the alarm when a hand is waved in the field of view of the sensor. Furthermore, the Braun alarm clock has a separate manually operated incandescent flashlight.

Another variation of such an alarm clock is the Remington Motion Control Projection clock. This clock, which features a dial displaying both analog and digital time, has a motion sensor that silences the alarm for eight minutes when a hand is waved in the field of view of the sensor. In addition, the clock has a projection "window" on top which permits the digital time to be projected onto the ceiling of a room by activating a switch. The lighting for the projection is in the form of incandescent light.

Although the above discussed alarm clocks have proven satisfactory for their intended purposes, it is desired to design a motion controlled alarm clock which incorporates electroluminescent technology so that the alarm clock is illuminated to a distinctly uniform brightness. Furthermore, it is desired to incorporate the flashlight feature into an electroluminescent alarm clock without requiring that there be a flashlight separate from the clock. By combining the flashlight feature with the clock, components, and ultimately the cost, can be reduced. Therefore, it is the object of the present invention to incorporate the flashlight feature and the alarm clock feature into an electroluminescent dial of a motion controlled alarm clock.

SUMMARY OF THE INVENTION

Briefly stated, the present invention concerns an improved alarm clock of the type having an alarm sounding mechanism, a motion sensor, and means coupled to the alarm sounding mechanism and the motion sensor for deactivating the alarm sounding mechanism for a preselected time interval when the alarm sounding mechanism is activated, wherein the improvement comprises a time display comprising an electroluminescent dial, a manual alarm actuator having a lip cover, the lip cover covering the motion sensor when the manual alarm actuator is set in the OFF position, a flashlight actuator, a driving circuit coupled to the electroluminescent dial for activating the electroluminescent dial to two distinct brightness levels, and circuit means coupled to the motion sensor, the flashlight actuator, and the driving circuit for selecting the desired brightness level.

BRIEF DESCRIPTION OF THE DRAWINGS

The subject matter, which is regarded as the invention, is particularly pointed out and distinctly claimed in the concluding portion of the specification. The invention, however, both as to organization and to method of practice, together with further objects and advantages thereof, may best be understood by reference to the following description, taken in connection with the accompanying drawings, in which:

DETAILED DESCRIPTION OF THE PREFERRED EMBODIMENT

Figure 1:
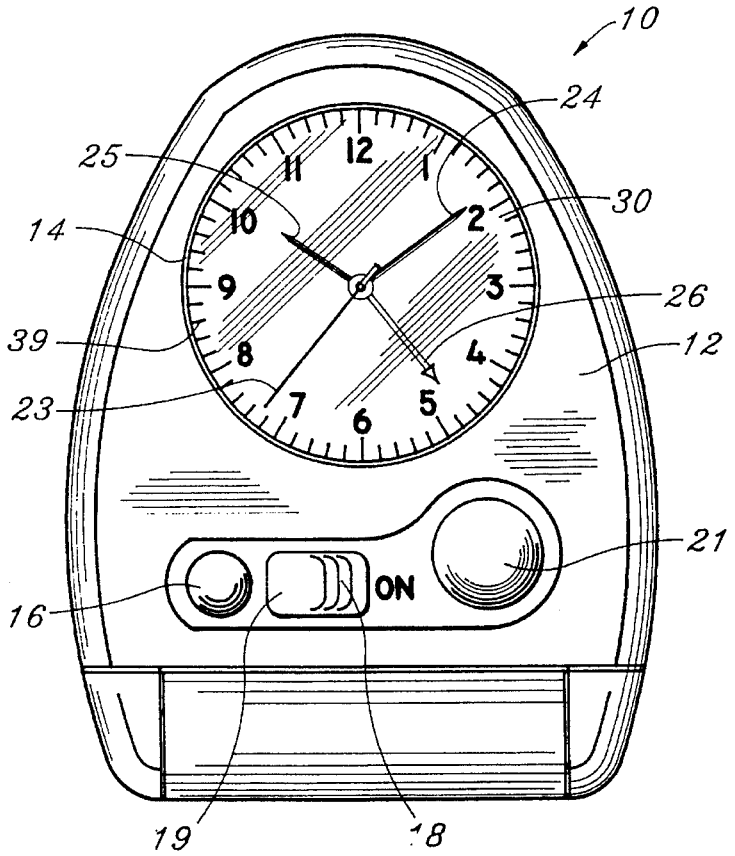
FIG. 1 is a frontal view of an alarm clock of the present invention in an open position.
Figure 2:
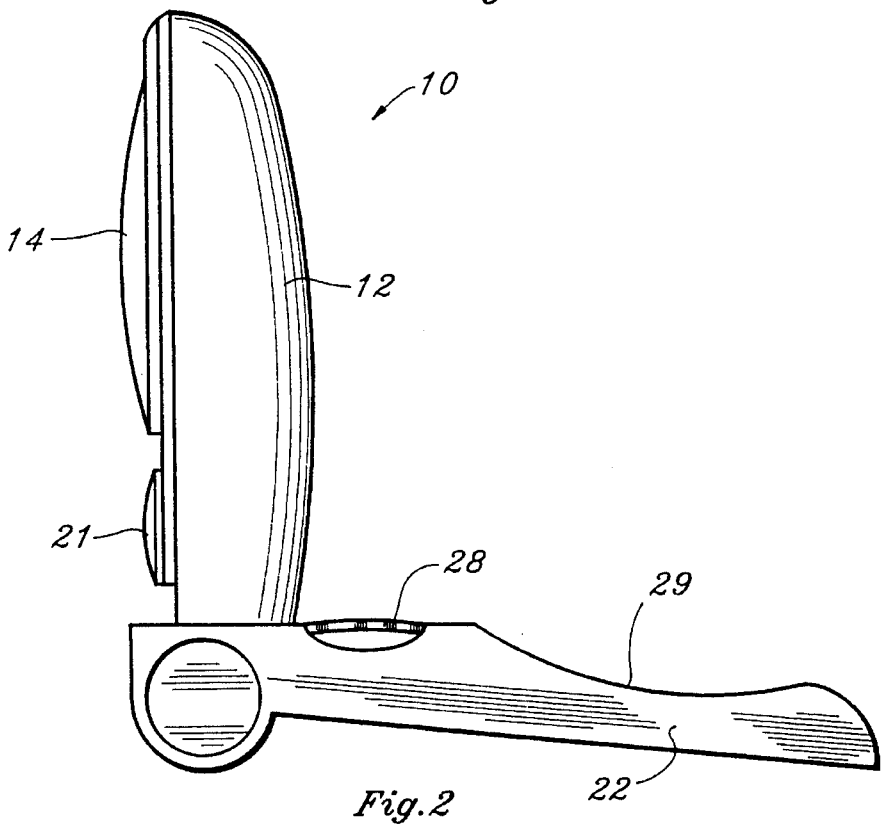
FIG. 2 is a side view of the alarm clock of FIG. 1.
Figure 3:
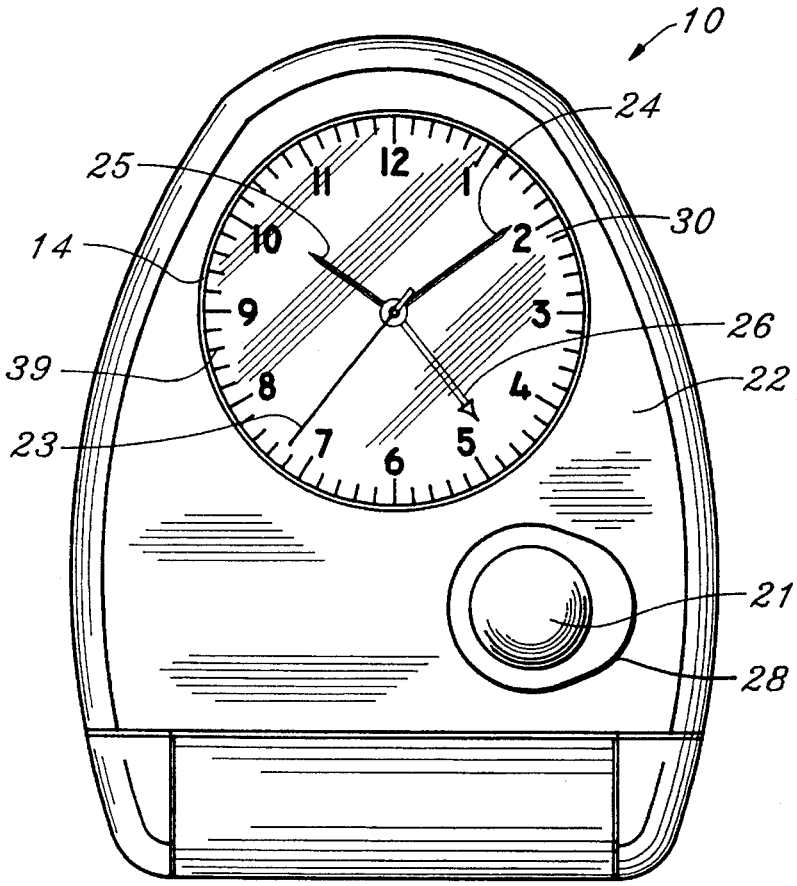
FIG. 3 is a frontal view of the alarm clock of FIG. 1 in a closed position.

FIGS. 1–3 illustrate the preferred embodiment of an alarm clock 10 of the present invention. Although the alarm clock 10 is depicted in analog form, the clock 10 may also be digital. The following discussion will describe, where appropriate, the differences between the invention as an analog clock and the invention as a digital clock.

The alarm clock 10 comprises a case 12, inside of which is located an alarm sounding mechanism and other circuit components to be described later, a time display 14, a motion sensor 16, a slidable alarm switch 18 having a lip cover 19, a flashlight push button 21, and a hinged protective cover 22 which dually functions as a stand for the alarm clock 10. The hinged protective cover 22 has a first opening 28 corresponding to the flashlight push button 21 and a second opening 29 corresponding to the time display 14, so that when the hinged protective cover 22 is positioned to mate with the case 12 (i.e., closed position) as shown in FIG. 3, only the flashlight push button 21 and the time display 14 are exposed to view. The function of the lip cover 19 is to cover the motion sensor 16 when the alarm switch 18 is set in the OFF position, thereby preventing the motion sensor 16 from detecting motion. This offers two advantages: First, a user of the alarm clock 10 can simply determine if the alarm is armed by waving his/her hand in front of the clock 10. If the time display 14 lights up (as will be described later), then the user knows that the alarm is armed. If the time display 14 does not light up, then the user knows that he/she must activate the alarm by setting the alarm switch 18 in the ON position. Second, by permitting the user to select when the motion sensor 16 is to be activated, the alarm clock 10 expends less power than it would if the motion sensor 16 is always activated.

Figure 4:
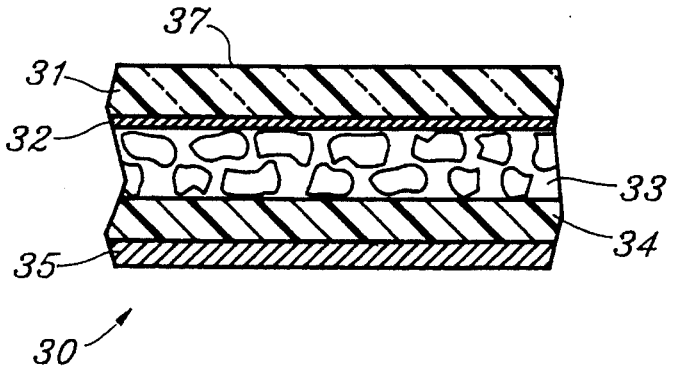
Fig. 4 Prior Art
FIG. 4 is an enlarged side elevational view in cross section of an archetypal, prior art EL lamp.

The time display 14, as illustrated in FIGS. 1 and 3, comprises a second hand 23, a minute hand 24, an hour hand 25, an alarm hand 26, and an electroluminescent (EL) dial 30. The hands 23–26 are mounted on rotatable stems (not shown) and driven by a conventional time movement, the details of which are not material to the present invention. The setting of the hands to indicate the correct time, including the desired alarm time, may be accomplished by one of several well-known means. For example, the time and the alarm time may be set by a rotatable member (not shown) protruding externally from the rotatable stems. The EL dial 30 is preferably of the type disclosed in U.S. Pat. No. 4,775,964, issued on Oct. 4, 1988 and assigned to the present assignee. FIG. 4 shows a side elevational view in cross section of the EL dial 30.

Note that FIG. 4 is not to scale, and the layers are greatly enlarged for purposes of illustration, it being understood that some of the layers referred to herein are quite thin. The EL dial 30 comprises a transparent substrate 31 having deposited thereon a first conductive layer 32. Commercially, the substrate 31 with the conductive layer 32 already on it is available in the form of Mylar® (a registered trademark of E. I. duPont de Nemours & Co.) having an indium tin oxide (ITO) coating. On the first conductive layer 32, which may also be referred to as the front electrode, an electroluminescent layer 33 is deposited by silk screening or another suitable process. The electroluminescent layer 33, as known, comprises electroluminescent particles such as ZnS:Cu which are thoroughly mixed in a polymerizable resin, with the resin being subsequently polymerized. On the electroluminescent layer 33, an insulating layer 34 is deposited. The insulating layer 34 may be composed of barium titanate or other appropriate dielectrics. Finally, a second conductive layer 35, which may also be referred to as the back electrode, is deposited on the insulating layer 34.

Where the EL dial 30 is to be utilized in the analog version of the present invention, indicia 39, as are shown in FIGS. 1 and 3, may be printed onto the top surface 37 of the transparent substrate 31 by transfer printing or silk screening, employing conventional techniques of the same type which are presently used to manufacture analog EL dials (see the aforementioned '964 patent). For the digital version of the present invention, an EL lamp having the construction shown in FIG. 4 is disposed behind an electro-optical display, such as a liquid crystal display (LCD), to provide backlighting. Thus, by activating the EL lamp, the electro-optical display is provided with illumination. As is known, an EL lamp is activated by applying an electrical potential between the front and back electrodes.

The EL dial 30 for the alarm clock 10 of the present invention is coupled to a drive circuit located inside the case 12 which is designed to activate the EL dial 30 to two distinct brightness levels. Two possible circuit means for achieving this desired result will be discussed herein. First, the EL dial 30 could be activated to two distinct brightness levels by utilizing a variation of the drive circuit disclosed in the co-pending application of Kamens et al., Ser. No. 08/4273 19, filed on Apr. 24, 1995. The drive circuit disclosed in the co-pending application of Kamens et al., Ser. No. 08/427,319 makes use of the well-known fact that the brightness of an EL lamp is dependent on the applied voltage. As described therein, the drive circuit progressively charges the EL lamp with current pulses until the desired brightness is achieved. By having means for controlling the number of current pulses provided to the EL lamp, the drive circuit permits activation of the EL lamp to different brightness levels (the brightness level is directly correlated to the number of current pulses; i.e., the greater the number of current pulses, the greater the brightness, and vice versa). For purposes of the present invention, the drive circuit disclosed in the co-pending application of Kamens et al., Ser. No. 08/427,319 would be modified in a known manner to provide the two levels of brightness to the EL dial 30.

Second, the EL dial 30 could be activated to two distinct brightness levels by introducing a switch-controlled circuit element to a conventional drive circuit for an EL lamp. Such a conventional drive circuit for an EL lamp is disclosed in U.S. Pat. No. 4,527,096 issued on Jul. 2, 1985, and assigned to the assignee of the present invention. The drive circuit of the '096 patent includes a converter which multiplies ("boosts") the voltage of the power source by approximately twenty to thirty times. This converter utilizes an inductor, shown by reference numeral 12 in FIG. 1 of the '096 patent. The desired dual brightness levels can be achieved by controlling the voltage applied across the inductor 12, as illustrated in FIGS. 5 and 6.

Figure 5:
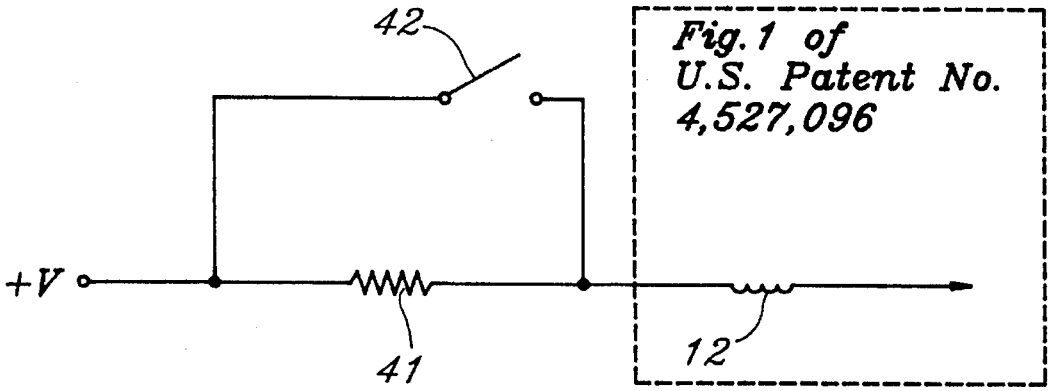
FIG. 5 illustrates a first switch-controlled circuit element for activating a conventional drive circuit for an EL lamp to two distinct brightness levels.

In FIG. 5, a resistor 41 coupled to a switch 42 is connected in series with the inductor 12 of the drive circuit of the '096 patent. As is known, closing and opening of switch 42 alters the voltage applied across the inductor 12. Since the brightness of an EL lamp is dependent upon the voltage applied across the inductor 12, the switch 42 permits the drive circuit of the '096 patent to provide two levels of brightness to the EL dial 30. The resistance value of the resistor 41 will determine the difference in brightness of the two levels. Note that the EL dial 30 will be brighter when the switch 42 is closed.

Figure 6:
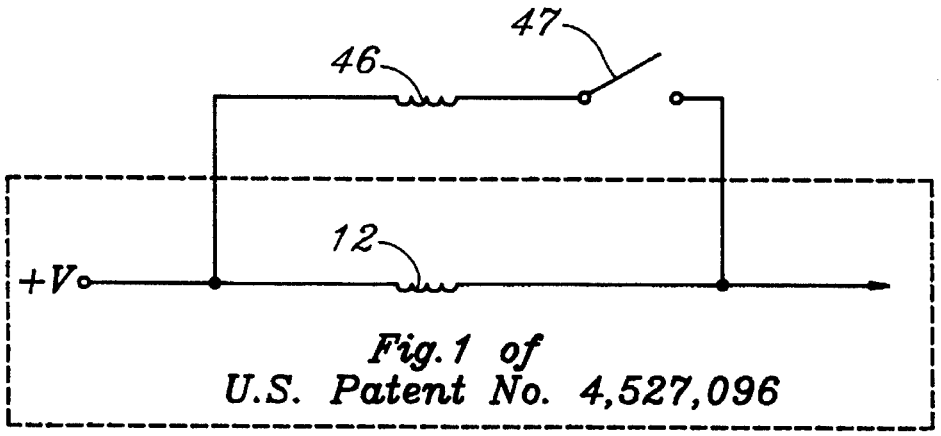
FIG. 6 illustrates a second switch-controlled circuit element for activating a conventional drive circuit for an EL lamp to two distinct brightness levels.

FIG. 6 shows a second inductor 46 coupled to a switch 47, with the second inductor 46 and the switch 47 connected in parallel to the inductor 12 of the drive circuit of the '096 patent. As is the case for FIG. 5, the closing and opening of switch 47 alters the voltage applied across the inductor 12. Thus, this permits the drive circuit of the '096 patent to provide two levels of brightness to the EL dial 30. It should be apparent to those skilled in the art that FIGS. 5 and 6 represent only two possible ways of manipulating a conventional drive circuit to provide two different levels of brightness to the EL dial 30.

Note that where even greater voltage boost than that provided by the converter for the drive circuit of the '096 patent is desired, the converter for the '096 patent may be replaced by another voltage boosting circuit, such as the voltage boosting circuit illustrated in FIG. 2 of U.S. Pat. No. 5,418,434 issued on May 23, 1995, and assigned to the assignee of the present invention. The voltage boosting circuit shown in FIG. 2 of the '434 patent may be modified in a manner similar to those depicted in FIGS. 5 and 6 above to activate the EL dial 30 to two distinct brightness levels.

Figure 7:
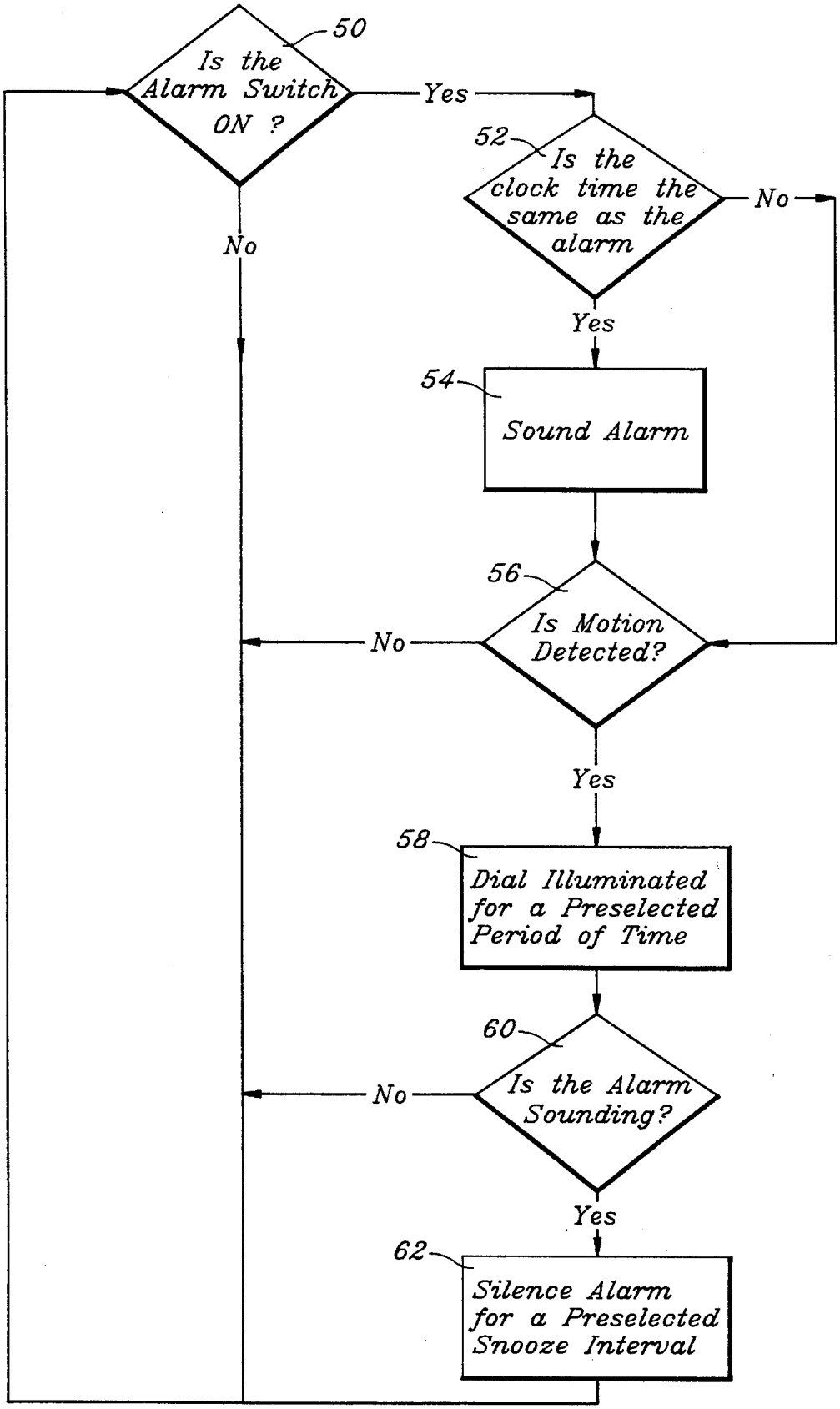
FIG. 7 is a flow chart depicting the operation of the alarm clock of the present invention.

The operation of the alarm clock 10 of the present invention will be described in conjunction with the flow chart shown in FIG. 7. The operation of the alarm clock 10 is controlled by a microprocessor located inside the case 12. The first step 50 of the operation is determining whether the slidable alarm switch 18 has been set in the ON position. If the answer is "no," then step 50 is repeated after a predetermined length of time. If the answer is "yes," then a determination is made at step 52 with respect to whether the clock time is the same as the alarm time set. If the clock time is the same as the set alarm time, then the alarm sounding mechanism is activated at step 54. The next step 56 of the operation is determining whether motion has been detected by the motion sensor 16. Where no motion has been detected, the microprocessor of the alarm clock 10 returns to step 50. If motion has been detected by the motion sensor 16, then the EL dial 30 is made to illuminate to the lesser brightness level for a preselected period of time (e.g., five seconds) at step 58. The circuit means for selecting the lesser of the two brightness levels at step 58 may be any one of many conventional means known in the art; thus, it will not be discussed herein. The following step 60 of the operation is determining whether the alarm sounding mechanism has been activated. If the answer is "no," then the operation is returned to step 50. If the answer is "yes," then the alarm sounding mechanism is deactivated temporarily for a preselected snooze interval (e.g., five minutes) at step 62 by means known in the art. After step 62, the operation is returned to step 50.

Note that a counter is preferably incorporated into the microprocessor so that a count may be kept of the number of times step 62 occurs. The counter can then be used to prevent step 62 from occurring after a preselected number of times. For example, the microprocessor may be programmed to allow a user of the alarm clock 10 to temporarily deactivate the alarm sounding mechanism (step 62) for up to five times. After the fifth time, waving of the hand in the "field of view" of the motion sensor 16 will not deactivate the alarm sounding mechanism. Also, in a manner known in the art, the counter can be used to make the alarm sounding mechanism get progressively louder each time it is reactivated after the preselected snooze interval.

In addition to the operation of the alarm clock 10 described in conjunction with FIG. 7, there is one more function of the alarm clock 10 which will be discussed presently. When the user depresses the flashlight push button 21, the EL dial 30 is illuminated to the greater brightness level by the drive circuit. The means for selecting the greater of the two brightness levels is well-known in the art. This permits the user to utilize the alarm clock 10 as a flashlight. The EL dial 30 will cease to be illuminated when the user releases the flashlight push button 21.

The alarm clock 10 of the present invention is contemplated to be used in the following manner. Note that the situation described hereupon is only exemplary. The user, prior to going to sleep, sets the alarm time and sets the alarm switch 18 in the ON position. When the user wakes up in the middle of the night to proceed to the bathroom, the user waves his/her hand in front of the alarm clock 10 to illuminate the time display 14 for the preselected period of time. The temporarily illuminated time display 14 permits the user to tell the time, and also permits the user to locate the exact position of the flashlight push button 21. The user can then depress the flashlight push button 21 to find his/her way to and from the bathroom without awaking his/her partner. After the user has returned to bed, the alarm sounding mechanism of the alarm clock 10 will be activated at the set alarm time. By waving his/her hand in front of the alarm clock 10, the user can then utilize the "snooze" function of the alarm clock 10.

While there has been described what is considered to be the preferred embodiment of the invention, other modifications will occur to those skilled in the art, and it is desired to secure in the appended claims all such modifications as fall within the true spirit and scope of the invention.

We claim:

1. An improved alarm clock of the type having an alarm sounding mechanism, a motion sensor, and means coupled to the alarm sounding mechanism and the motion sensor for deactivating the alarm sounding mechanism for a preselected time interval when the alarm sounding mechanism is activated, wherein the improvement comprises:

a time display comprising an electroluminescent dial;

a manual alarm actuator having a lip cover, the lip cover covering the motion sensor when the manual alarm actuator is set in the OFF position;

a flashlight actuator;

a driving circuit coupled to the electroluminescent dial for activating the electroluminescent dial to two distinct brightness levels; and circuit means coupled to the motion sensor, the flashlight actuator, and the driving circuit for selecting the desired brightness level.

2. An alarm clock having an alarm sounding mechanism, which comprises:

a motion sensor;

a time display for displaying the time, including the alarm time, comprising an electroluminescent dial;

a slidable alarm switch having a lip cover, the lip cover covering the motion sensor when the slidable alarm switch is set in the OFF position;

a flashlight push button;

an alarm time setting means coupled to the time display;

a driving circuit coupled to the electroluminescent dial for activating the electroluminescent dial to two distinct brightness levels;

circuit means coupled to the motion sensor, the flashlight push button, and the driving circuit for selecting the desired brightness level; and means coupled to the motion sensor and the alarm sounding mechanism for deactivating the alarm sounding mechanism for a preselected time interval when the alarm sounding mechanism is activated.

3. The alarm clock according to claim 2, which further comprises a case upon which is disposed the motion sensor, the time display, the slidable alarm switch, the flashlight push button, and the alarm time setting means, the case housing the driving circuit, the circuit means, and the means for deactivating the alarm sounding mechanism for a preselected time interval.

4. The alarm clock according to claim 3, which further comprises a protective cover attached to the case, the protective cover serving as a stand and having a first opening corresponding to the flashlight push button and a second opening corresponding to the time display so that when the protective cover is positioned to mate with the case, only the flashlight push button and the time display are exposed to view.

5. The alarm clock according to claim 2, wherein the electroluminescent dial comprises a transparent substrate, and front and back electrodes having interposed therebetween an electroluminescent layer and an insulating layer.

6. The alarm clock according to claim 2, wherein the motion sensor is a pyroelectric infrared detector.

7. The alarm clock according to claim 2, wherein the driving circuit includes a voltage boosting circuit.

8. An analog alarm clock having an alarm sounding mechanism, which comprises:

a motion sensor;

a time display comprising a minute hand, an hour hand, an alarm hand, and an electroluminescent dial;

a manual alarm actuator having a lip cover, the lip cover covering the motion sensor when the manual alarm actuator is set in the OFF position;

a flashlight actuator;

an alarm hand setting means;

a driving circuit coupled to the electroluminescent dial for activating the electroluminescent dial to two distinct brightness levels;

circuit means coupled to the motion sensor, the flashlight actuator, and the driving circuit for selecting the desired brightness level; and means coupled to the motion sensor and the alarm sounding mechanism for deactivating the alarm sounding mechanism for a preselected time interval when the alarm sounding mechanism is activated.

9. The analog alarm clock according to claim 8, which further comprises a case upon which is disposed the motion sensor, the time display, the manual alarm actuator, the flashlight actuator, and the alarm hand setting means, the case housing the driving circuit, the circuit means, and the means for deactivating the alarm sounding mechanism for a preselected time interval.

10. The analog alarm clock according to claim 9, which further comprises a protective cover attached to the case, the protective cover serving as a stand and having a first opening corresponding to the flashlight actuator and a second opening corresponding to the time display so that when the protective cover is positioned to mate with the case, only the flashlight actuator and the time display are exposed to view.

11. The analog alarm clock according to claim 8, wherein the electroluminescent dial comprises a transparent substrate having indicia printed thereon, and front and back electrodes having interposed therebetween an electroluminescent layer and an insulating layer.

12. The analog alarm clock according to claim 8, wherein the motion sensor is a pyroelectric infrared detector.

13. The analog alarm clock according to claim 8, wherein the driving circuit includes a voltage boosting circuit.

14. The analog alarm clock according to claim 8, wherein the alarm hand setting means comprises a rotatable member protruding externally from the time display.

15. A digital alarm clock having an alarm sounding mechanism, which comprises:

a motion sensor;

a time display for displaying the time, including the alarm time, the time display comprising an electro-optical display and an electroluminescent lamp disposed behind the electro-optical display;

a manual alarm actuator having a lip cover, the lip cover covering the motion sensor when the manual alarm actuator is set in the OFF position;

a flashlight actuator;

an alarm time setting means coupled to the time display;

a driving circuit coupled to the electroluminescent dial for activating the electroluminescent dial to two distinct brightness levels;

circuit means coupled to the motion sensor, the flashlight actuator, and the driving circuit for selecting the desired brightness level; and means coupled to the motion sensor and the alarm sounding mechanism for deactivating the alarm sounding mechanism for a preselected time interval when the alarm sounding mechanism is activated.

16. The digital alarm clock according to claim 15, which further comprises a case upon which is disposed the motion sensor, the time display, the manual alarm actuator, the flashlight actuator, and the alarm time setting means, the case housing the driving circuit, the circuit means, and the means for deactivating the alarm sounding mechanism for a preselected time interval.

17. The digital alarm clock according to claim 16, which further comprises a protective cover attached to the case, the protective cover serving as a stand and having a first opening corresponding to the flashlight actuator and a second opening corresponding to the time display so that when the protective cover is positioned to mate with the case, only the flashlight actuator and the time display are exposed to view.

18. The digital alarm clock according to claim 15, wherein the electroluminescent lamp comprises a transparent substrate, and front and back electrodes having interposed therebetween an electroluminescent layer and an insulating layer.

19. The digital alarm clock according to claim 15, wherein the motion sensor is a pyroelectric infrared detector.

20. The digital alarm clock according to claim 15, wherein the driving circuit includes a voltage boosting circuit.

21. The digital alarm clock according to claim 15, wherein the electro-optical display is a liquid crystal display.

* * * * *